United States Patent [19]

Henning et al.

[11] Patent Number: 4,961,337

[45] Date of Patent: Oct. 9, 1990

[54] PARTS UNLOADER FOR TOP DELIVERY DIES

[75] Inventors: Thomas P. Henning, Fond du Lac; William O. Ellis, Beaver Dam, both of Wis.

[73] Assignee: Deere & Company, Moline, Ill.

[21] Appl. No.: 404,912

[22] Filed: Sep. 8, 1989

[51] Int. Cl.[5] ..... B21J 13/08

[52] U.S. Cl. ..... 72/426; 72/361

[58] Field of Search ..... 72/345, 361, 426, 427; 83/81, 82, 160; 198/535, 536; 193/4

[56] References Cited

FOREIGN PATENT DOCUMENTS 13423 1/1983 Japan ..... 72/427

*Primary Examiner*—Lowell A. Larson

[57] ABSTRACT

A portable and easily adjustable parts unloader which is usable with different types and sizes of power presses is provided by driving a parts remover tray through a simple cable and sheave arrangement and by mounting the parts remover on top of a telescopic post whose effective length is varied hydraulically so the height of the loader is easily changed for different presses. The post, in turn, is mounted on a wheeled cart so it is easily moved from one press to the other by a single operator. By using a simple pulley, the stroke of the parts remover tray is directly proportional to the stroke of the press ram, but the stroke of the tray can be made greater than and/or faster than the stroke of the ram by using a compound pulley in which the two pulley parts have different effective diameters.

14 Claims, 5 Drawing Sheets

PARTS UNLOADER FOR TOP DELIVERY DIES

FIELD OF THE INVENTION

The present invention relates generally to parts unloaders for use with power presses having top delivery dies and more specifically relates to such a parts unloader which is economical to manufacture, lightweight and easily portable, versatile in use and easily adjustable.

BACKGROUND OF THE INVENTION

Automatic parts removers are used to increase the efficiency or productivity of power presses having top delivery dies by automatically removing a formed or punched part without human intervention. These parts removers all have in common some type of reciprocal parts tray which moves under the press ram upon upward movement of the ram to receive the formed or punched part when ejected by the ram. In these prior art devices, the reciprocal movement of the parts tray was obtained through the use of rack and pinion-type gearing. For example, in prior art parts unloaders known to applicants, the tray is slidably mounted on a frame and is also provided with a rack which engages pinion gears on a shaft extending transversely to the direction of movement of the tray. One end of the transverse shaft is provided with an additional gear which is driven by a ram rack. The ram rack is in essence a tooth reciprocal shaft. In some cases the shaft is attached to the press ram through appropriate brackets and in other cases the ram rack is operated by pneumatic cylinders whose operation is timed with the operation of the ram through appropriate control means. In all cases the drives for the trays were expensive since there were many gears and racks which had to be of a hardened or special material. And, the stroke of the rack was very difficult to adjust. Also, because of all of the drive mechanisms required to operate these prior art unloaders, the unloaders were extremely heavy and cumbersome. Some were mounted directly onto the press bolster or bed and required multiple people to move them from one press to another. Some of the prior part unloaders were mounted on a portable frame to assist in movement from one press to another, but of those known to applicants, the only vertical adjustment was accomplished by individual adjustment of each of the wheels on the frame and this complicated and extended the required time for setup for different sized presses.

SUMMARY OF THE INVENTION

The principle object of the present invention is providing a simple and economical, but extremely versatile, parts remover with use with power presses having top delivery dies.

Another object of the present invention is to provide a highly portable and easily adjustable parts unloader which is usable with different types and sizes of power presses.

In the preferred embodiment of the invention, the above objects are accomplished by driving a parts remover tray through a simple cable and sheave arrangement and by mounting the parts remover on top of a telescopic post whose effective length is varied hydraulically so the height of the loader is easily changed for different presses. The post, in turn, is mounted on a wheeled cart so it is easily moved from one press to the other by a single operator. By using a simple pulley, the stroke of the parts remover tray is directly proportional to the stroke of the press ram, but the stroke of the tray can be made greater than and/or faster than the stroke of the ram by using a compound pulley in which the two pulley parts have different effective diameters.

The above objects and additional objects and advantages of the present invention will become apparent from a reading of the following detailed description of a preferred embodiment of the invention when taken in conjunction with the accompanying drawings of the preferred embodiment.

DESCRIPTION OF THE PREFERRED EMBODIMENT

Figures 1, 2:
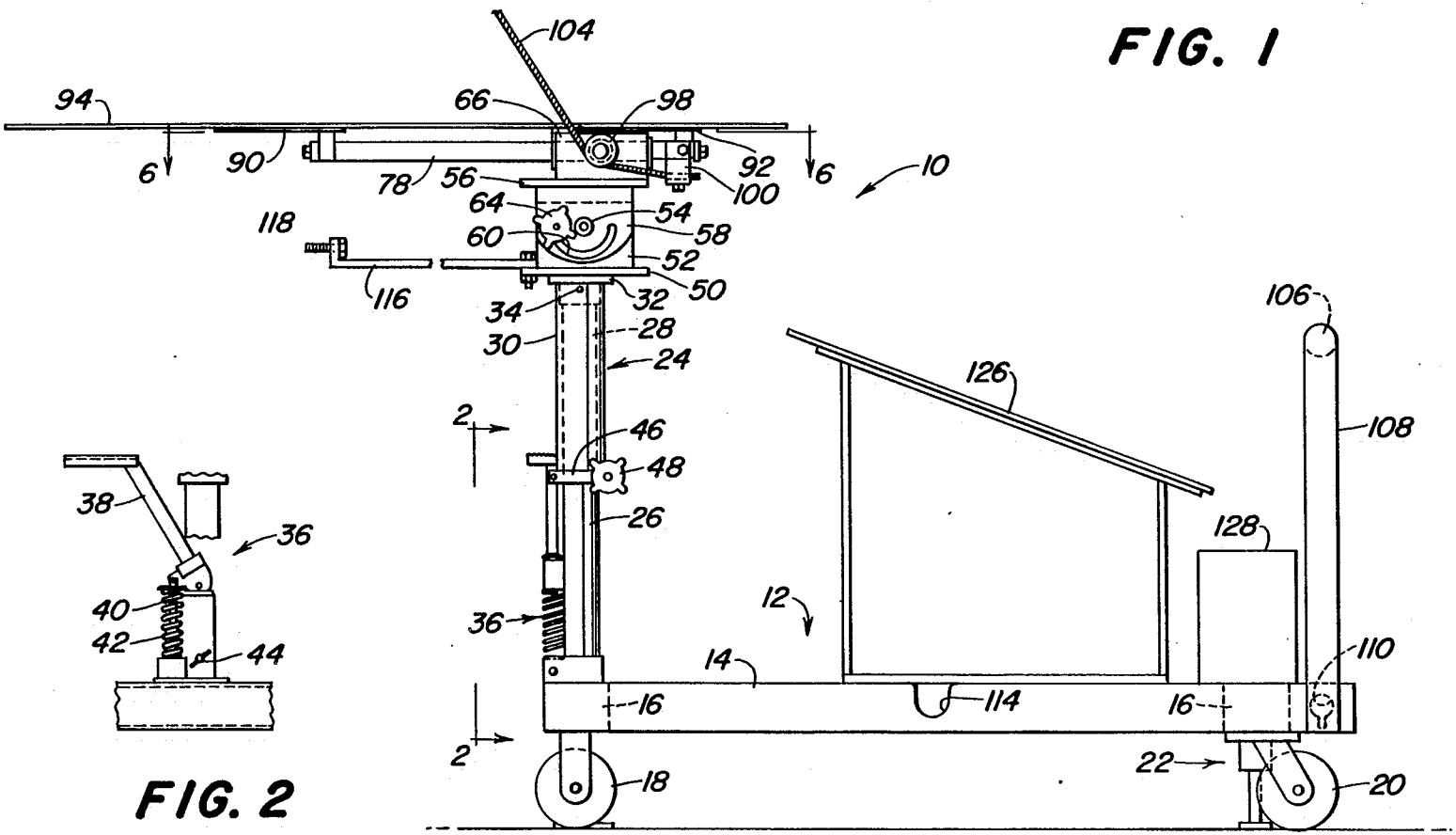
FIG. 1 is a side elevational view of a parts unloader according to the present invention.
FIG. 2 is a partial end view of the parts unloader shown in FIG. 1 taken along the lines 2—2.

The parts unloader as illustrated in the drawings is indicated generally by the reference numeral 10. The parts unloader includes a lower, generally rectangular, frame !2 made up of a pair of side beams 14 and a pair of end beams 16. The left end of the frame 12 as viewed in FIG. 1 is mounted on a pair of fixed position wheels 18 and the right end of the frame 12 is supported on a pair of swivelly mounted wheels 20. Also mounted on the right end beam 16 is a foot operated, high clearance floor lock indicated generally at 22. Any type of floor lock will suffice, but the one illustrated is available from Rapistan Wil-Mar, One Isley Road, Gastonia, North Carolina, as floor lock Model No. FL15.

A telescopic post 24 is mounted on the left end beam 16 with its longitudinal axis oriented generally vertically. Post 24 is basically of a two part construction, a lower part in the form of a hydraulic ram having a cylinder 26 with a rod 28 projecting therefrom and an upper part 30 in the form of a tubular sleeve slidable on the cylinder 26. The upper end of the sleeve 30 is closed by cap 32 which is of stepped construction so that one piece extends into the sleeve and is secured to the sleeve by pin 34. The ram 28 can either be secured to the end cap 32 in any suitable manner or simply bear against the end cap 32. Integrally associated with the hydraulic cylinder 26 is a manually controlled hydraulic pump 36 which includes a pivotally mounted foot pedal 38, a plunger 40 pivotally connected to the pedal, and a return spring 42 surrounding the plunger. As is conventional, a relief screw 44 is provided to permit retraction of the ram 28. The cylinder 26 and pump 36 can take any desired form, but preferably are a standard combination hydraulic lift table jack sold by Lexco Engineering and Manufacturing Corporation of Souderton, Pennsylvania.

The sleeve 30 is rotatable with respect to the cylinder 26 and is fitted with a clamp 46 at its lower end. The clamp 46 is provided with a threaded hand wheel 48 which serves to tighten the clamp 46 on the cylinder 26 and thereby prevent relative rotation between the sleeve 30 and cylinder 26.

A swivel support plate 50 is fixed on top of the end cap 32 and a swivel block 52 is fixed to the plate 50. The swivel block 52 is provided with a through bore which receives a suitable pivot pin 54. A slide support plate 56 is provided with a pair of depending side plates which extend along the sides of the swivel block 52, are suitably apertured and pivotally mounted on the pin 54. One of the side plates 58 is provided with an arcuate slot 60. A threaded end of a shaft 62 on a hand wheel 64 extends through the slot 60 and into a threaded bore in the swivel block 52. The shaft 62 and associated handle 64 can be used to clamp the side plate 58 against the swivel block 52 to hold the slide support plate 56 in any adjusted angular position with respect to the post 24.

A guide assembly is supported on the plate 56 and includes a bearing block 66. The block 66 is provided with a pair of parallel, through bores 68. A linear bearing 70 is mounted in each end of each of the bores 68. A pair of retainer plates 72 having openings corresponding with the openings through the bearings 70 are fastened to the sides of the bearing block 66 by screws 74 to prevent the bearings 70 from exiting the bores. Spacers 76 are positioned in the bores 68 between the bearings 70 to keep the bearings 70 spaced apart and in engagement with the retainer plates 72.

A slide frame is supported by the bearing block for reciprocal movement and includes a pair of spaced, parallel rods 78, a pair of spacer bars 80 and a pair of end caps 82. The rods 78 extend through the bores 68 and linear bearings 70 and extend from either end thereof. The spacer bars 80 are apertured to receive the rods 78 and are positioned over the extreme end of the rods to retain the opposite ends of the rods properly spaced to prevent binding within the bearings 70. The end caps 82 are secured to the ends of the rods 78 by bolts 84 and are also secured to the spacer blocks 80 by additional bolts 86 to hold the spacer blocks 80 at the ends of the rods 78.

The spacer blocks 80 are also provided with tapped holes 88 and forward and rearward tray support plates 90 and 92 are secured on the bars 80 by flathead screws. Finally, a parts remover tray 94 is mounted on the support plates 90, 92 by additional flathead screws. The supports plates 90 and 92 and/or the parts removal tray 94 are provided with a series of openings (see FIG. 4) for receiving the flathead screws so that the parts remover tray 94 can be mounted in any one of a plurality of positions with respect to the slide frame.

Figure 3:
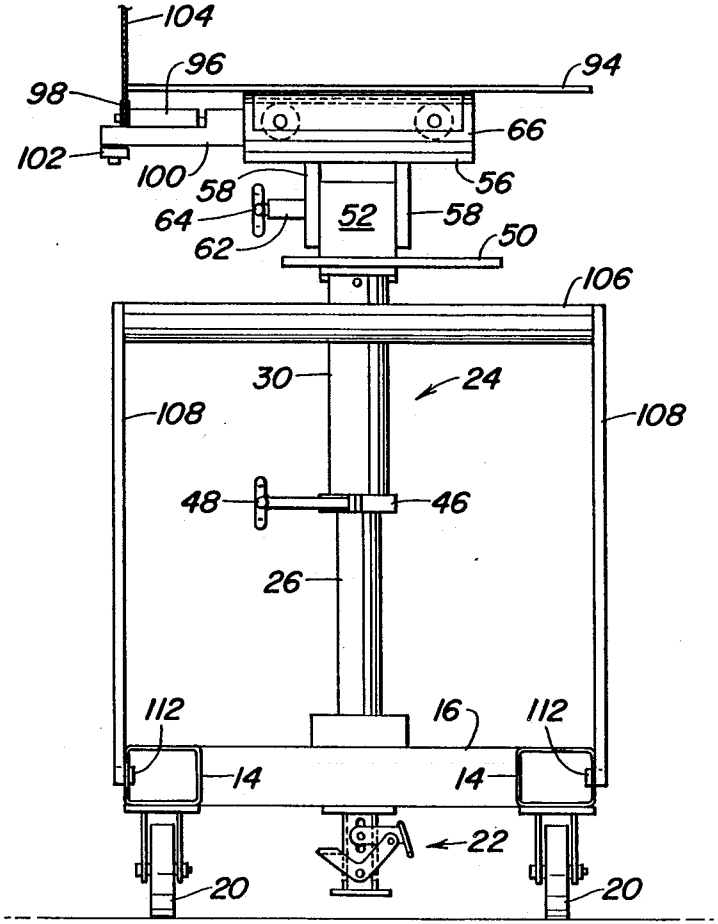
FIG. 3 is an elevational view of the right end of the parts unloader as shown in FIG. 1.
Figure 4:
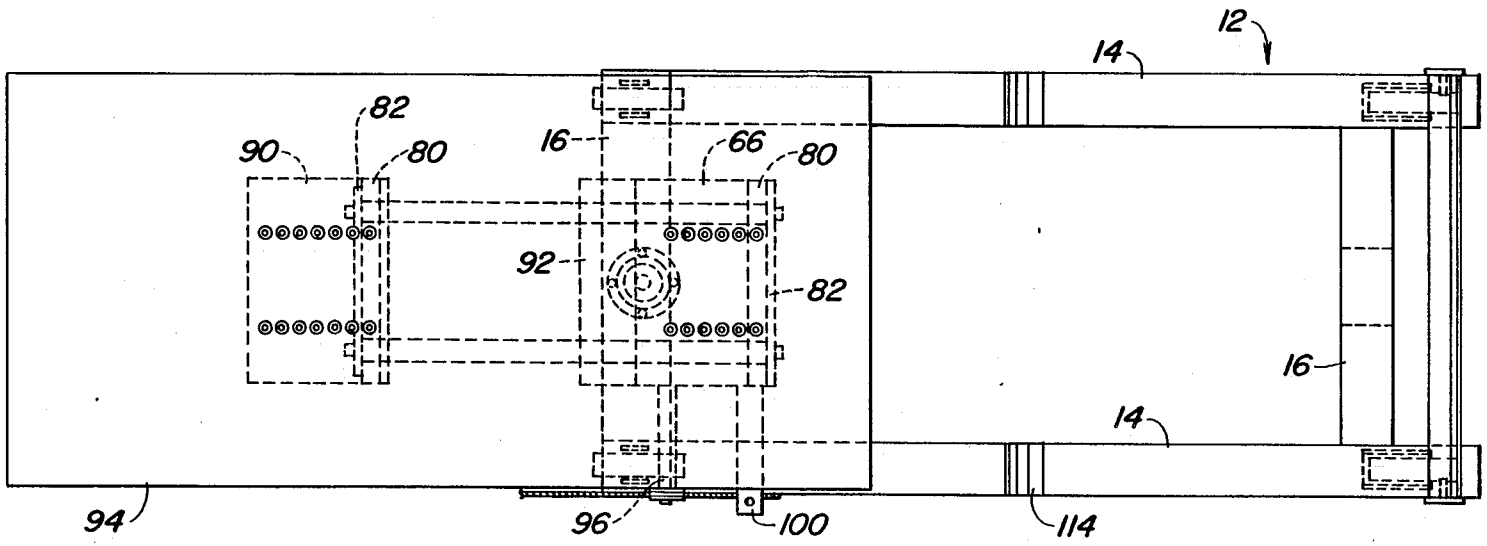
FIG. 4 is a top plan view of the parts unloader shown in FIG. 1.
Figure 6:
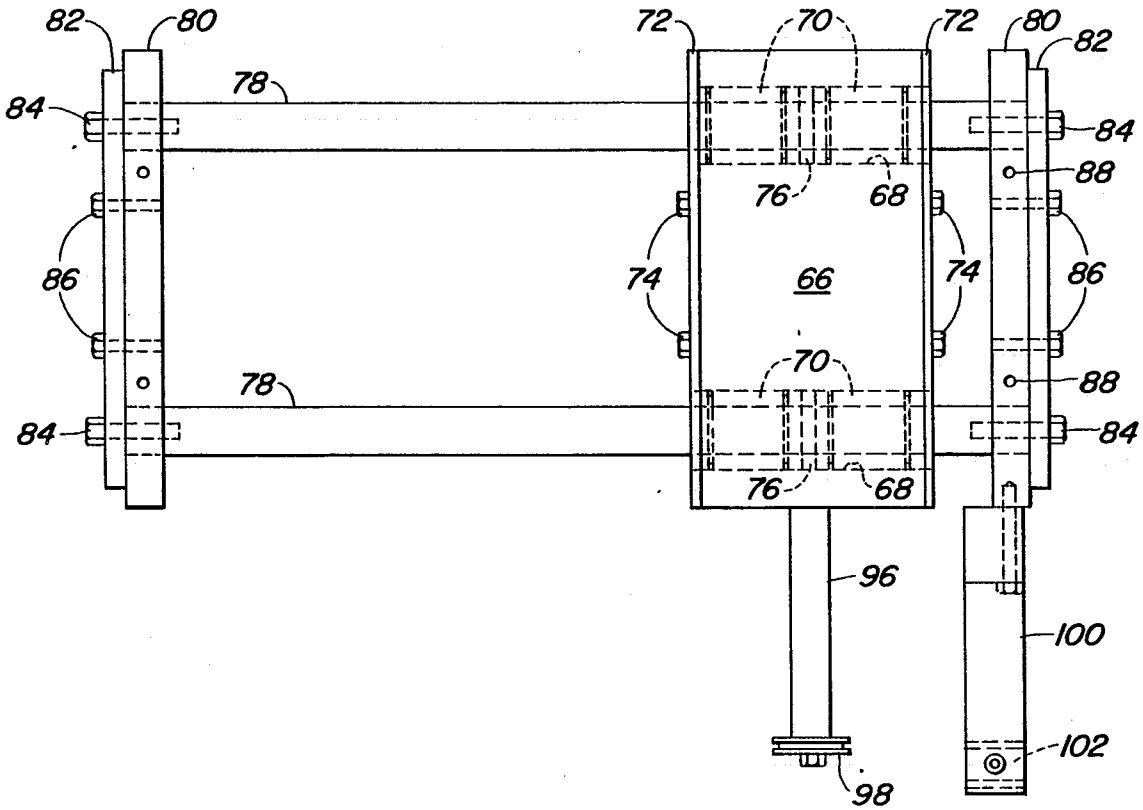
FIG. 6 is an enlarged top view of a portion of a parts unloader illustrated in FIG. 1.

A pulley support 96 is rigidly supported on the bearing block 66 and extends laterally therefrom a distance sufficient to extend slightly beyond the widest parts tray intended to be used with the unloader (see FIGS. 3 and 4). A pulley 98 is rotatably mounted at the outer end of the pulley support 96. An anchor bracket 100 is rigidly secured to the rear or left spacer bar 80 as viewed in FIG. 6, and forms, in combination with a clamp block 102, a means for securing a cable 104 to the slide frame. The anchor bracket 100 extends outwardly from the spacer block 80 beyond the pulley 98 so that when the cable 104 is clamped between the bracket 100 and block 102, it is in line with the pulley 98.

A generally U-shaped handle formed of a crossbar 106 and a pair of straps 108 is mounted on the right end of the lower frame 12. For this purpose, each of the beams !4 is provided with a key-shaped slot 110 and the lower end of each of the straps 108 is provided with an elongated tab 112 which is positioned in the respective key-shaped slot. When the tabs 112 are in the lower narrow portion of the key-shaped slot, the handle is retained in a vertical position. If the handle is lifted vertically so that the tabs 112 are in the large part of the key-shaped slot, the handle can be pivoted forwardly and downwardly to a stored position. To get the handle completely out of the way when in the stored position, the beams 14 are provided with cut out portions 114 which receive the crossbar 106 of the handle.

In order to hold the unloader in a more stationary position with respect to a press, a tie bar 116 may be optionally mounted on the swivel support plate 50, and extend away from the post 24 in the same direction as the unloader tray 94. At its free end, the tie bar 116 is provided with any suitable means such as a screw 118 for securement to the press.

Figures 5, 7:
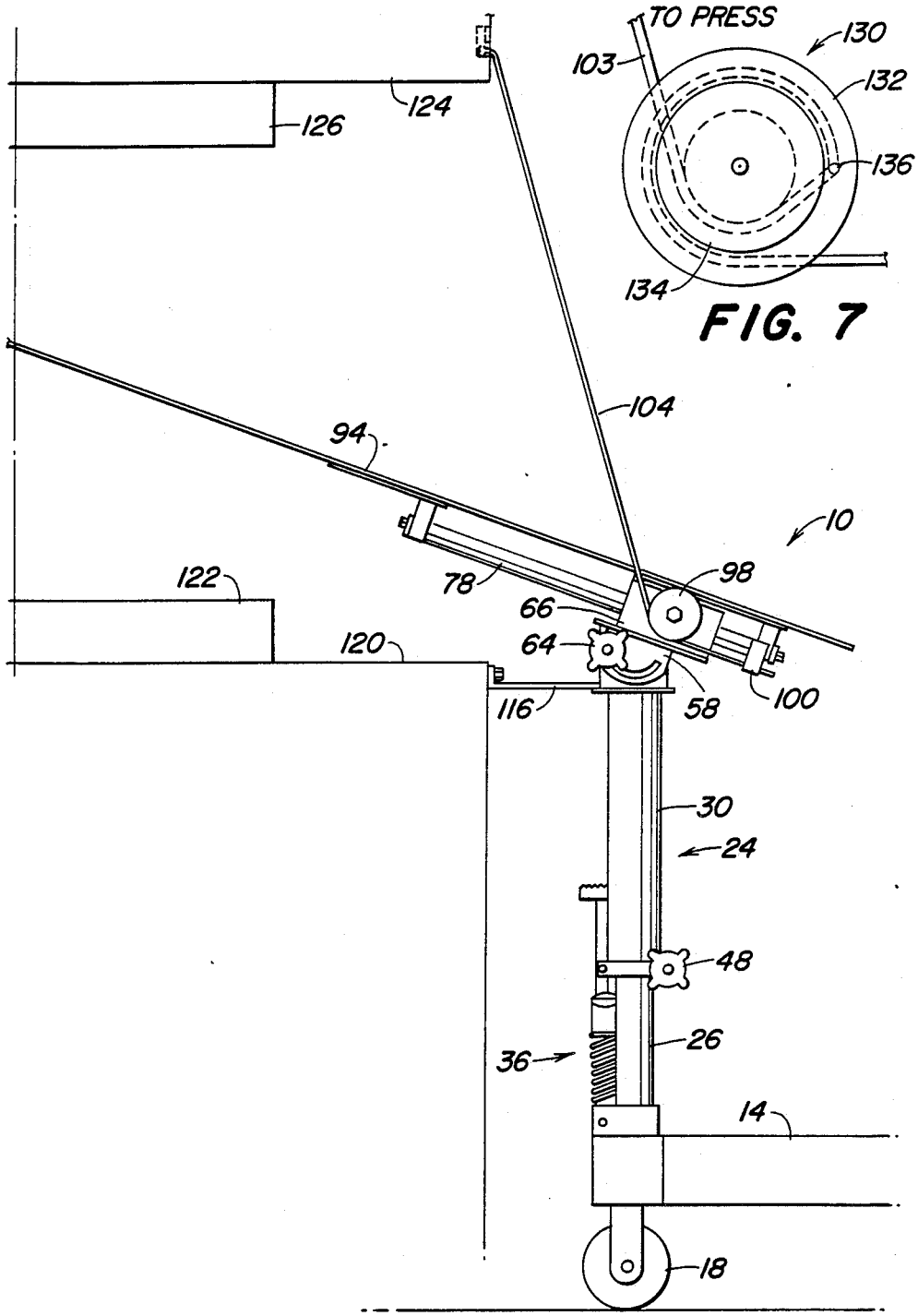
FIG. 5 is an illustration of the parts unloader associated with a schematically shown power press.
FIG. 7 is an illustration of an alternate pulley to be used on the parts unloader illustrated in FIG. 1.

The unloader illustrated in FIG. 1 shows the parts unloader tray 94 in a horizontal position. This illustration is for convenience only since the unloader tray will normally be positioned at an angle with respect to the post 24 as illustrated in FIG. 5. FIG. 5 illustrates the unloader in combination with a schematically illustrated press including a bed 120, a die !22 mounted on the bed, a ram 124 and a punch 126 carried by the ram. As shown in FIG. 5, the unloader is wheeled up to the press and secured to the press bed through the tie bar 116. The opposite end of the lower frame can be locked in a secured position by the floor lock 22. The height of the unloader tray is adjusted through the use of the pump 36 and the angle of the parts unloader tray 94 is properly adjusted through the use of the hand wheel 64. The cable !04 which is anchored to the slide frame is positioned under the pulley 98 and then has its opposite end attached to the ram 124 of the press. As shown in FIG. 5, the cable 104 is provided with an enlargement which extends into a bayonet-type slot in the ram. As shown in FIG. 5, the ram is in a raised position and the parts unloader tray 94 is in an extended position under the punch 126 where is can receive a part ejected from the punch. After a new piece is placed on the die 122 and the ram begins to move downwardly, the cable 104 is relaxed and the parts tray 94 along with the slide frame is permitted to move downwardly and to the right as seen in FIG. 5 under the influence of gravity so that the parts tray 94 moves out from under the punch !26. After a part is formed or punched, the ram will again move upwardly causing the tray 94 to again move under the punch 126.

If the unloader is to be used with a press which does not permit the parts tray 94 to be used at a sufficient angle so that gravity provides proper return, a suitable return spring can be positioned anywhere between the bearing block and slide frame.

Referring back to FIG. 1, there is shown a slide 126 and small box 128 sitting on the lower frame 12. These do not form any part of the invention, but show how small parts dropped from the unloader can be moved from the parts remover tray 94 to a container 128 for later removal in bulk. For some parts, and if the parts remover is used with a press of sufficient size, the handle can be moved to a stored position and a large wheeled cart carrying a parts tub can be moved directly over and straddle the lower frame !2 so that parts go directly from the removal tray 94 to the tub. In some situations it may be necessary to use a lowboy-type tub, and in this case the lower frame 12 can be rotated out of the way by loosening of the screw wheel 48 so that the cylinder 26 is free to rotate with respect to the sleeve 30. A lowboy tub can then be moved into position to receive the parts directly from the removal tray 94.

It has been found in some cases that it is necessary to move the parts removal tray 94 at a rate greater than the movement of the press ram and through a greater distance. This can be achieved by substituting a compound pulley or a pair of joined pulleys having different effective diameters for the pulley 98. Such a compound or dual pulley is illustrated in FIG. 7 by the reference numeral 130 and includes a large diameter portion 132 and a small diameter portion 134. An opening 136 extends through the wall between the small and large diameter portions of the pulley I30. A cable 104 is shown as extending from the press under the small diameter portion of the pulley, through the opening 136 and then around the large diameter portion of the pulley in the same direction as its extends around the small diameter portion, and on to the anchor bracket. Depending upon the size of the pulley and the stroke of the press ram, it may be necessary to have the cable extend around the respective pulleys more than once. As shown in FIG. 7, the cable which extends around the small diameter portion of the pulley is almost fully removed since the parts are shown in the positions they would assume when the press ram is in the upper position.

Having thus described a preferred embodiment of the invention, various modifications within the spirit and scope of the invention will become apparent to those skilled in the art can be made without departing from the underlying principles of the invention. Therefore, the invention should not be limited to the specific embodiment described and illustrated, but should only be limited by a fair interpretation of the following claims.

We claim:

1. A parts unloader for use with a press having a top delivery die comprising:

a lower frame;

a support on said lower frame including a generally upright post having first and second parts slidably mounted with respect to each other for telescopic lengthening and shortening of the post;

a manually controllable power means for controlling telescopic adjustments of the post;

guide means adjustably mounted on the upper end of said post for movement about a generally horizontal axis;

means for locking said guide means in any angularly adjusted position with respect to said post;

a slide frame slidably mounted on said guide means for reciprocal movement with respect thereto and at an angle with respect to the support dependent on the angular adjustment of the guide means;

a part tray fixed to said slide frame for movement therewith and having an end extending beyond one end of the slide frame;

pulley means mounted on the guide means for rotation about an axis parallel to the generally horizontal axis; and anchor means on an end of said slide frame opposite from said first mentioned end adapted to anchor a flexible cable;

whereby, said parts unloader is usable with different sizes of presses and when said parts unloader is positioned next to a press with a top delivery die with the first mentioned end of the slide frame positioned next to the press and a cable is trained about said pulley means and anchored to said anchor means and the ram of the press, upward movement of the press ram will cause said part tray to move under the press ram and die, and downward movement of the press ram will permit said part tray to move away from under said press ram and die.

2. A parts unloader as set forth in claim 1 wherein said power means includes a hydraulic ram forming one part of the post, and a manually operable hydraulic pump interconnected with said ram.

3. A parts unloader as set forth in claim 1 wherein said guide means includes a guide block having a pair of parallel bores provided therein and a linear bearing mounted in each end of each bore;

said slide frame includes a pair of rods extending through said bores and bearings and means interconnecting the ends of said rods; and said part tray is mounted on the interconnecting means.

4. A parts unloader as set forth in claim 3 wherein said pulley means is mounted on said guide block and said anchor means is carried by the interconnecting means.

5. A parts unloader as set forth in claim 1 wherein said lower frame is generally of rectangular shape and is mounted on wheels;

said post is mounted on one end of said frame and the first and second parts thereof are rotatable with respect to each other; and a cart handle is mounted on said frame opposite from said post for movement between a lower position in which it locked in an upright position and an upper position in which it is movable between the upright position and a horizontal position overlying the cart.

6. A parts unloader for use with a press having a top delivery die comprising:

a lower frame of generally rectangular shape mounted on wheels;

a support mounted on one end of said frame and including a post having a first lower and a second upper part rotatable with respect to each other;

means provided on one of said post parts to lock said post parts with respect to each other;

guide means adjustably mounted on the upper post part for movement about a generally horizontal axis;

means for locking said guide means in any angularly adjusted position with respect to said post;

a slide frame slidably mounted on said guide means for reciprocal movement with respect thereto and at an angle with respect to the post dependent on the angular adjustment of the guide means;

a parts tray fixed to said slide frame for movement therewith and having an end extending beyond one end of the slide frame;

pulley means mounted on the guide means for rotation about an axis parallel to the generally horizontal axis; and anchor means on an end of said slide frame opposite from said first mentioned end adapted to anchor a flexible cable;

whereby, when said parts unloader is positioned next to a press with a top delivery die with the first mentioned end of the slide frame positioned next to the press and a cable is trained about said pulley means and anchored to said anchor means and the ram of the press, upward movement of the press ram will cause said parts tray to move under the press ram and die, and downward movement of the press ram will permit said parts tray to move away from under said press ram and die and said lower frame may be rotated with respect to the upper post part, guide means, slide frame, parts tray, and the press without changing the orientation of the parts tray with respect to the press.

7. A parts unloader as set forth in claim 6 wherein said first and second parts of said post are slidably mounted with respect to each other for telescopic lengthening and shortening of the post to vary the vertical position of the guide means; and a manually controllable power means is provided to control telescopic adjustments of the post.

8. A parts unloader as set forth in claim 7 wherein said power means includes a hydraulic ram forming one part of the post, and a manually operable hydraulic pump interconnected with said ram.

9. A parts unloader as set forth in claim 8 wherein said guide means includes a guide block having a pair of parallel bores provided therein and a linear bearing mounted in each end of each bore;

said slide frame includes a pair of rods extending through said bores and bearings and means interconnecting the ends of said rods; and said part tray is mounted on the interconnecting means.

10. A parts unloader as set forth in claim 9 wherein said pulley means is mounted on said guide block and said anchor means is carried by the interconnecting means.

11. A parts unloader as set forth in claim 10 wherein said pulley means includes first and second joined pulleys with the first having an effective diameter greater than the effective diameter of the second, whereby, when the flexible cable is anchored to the anchor means, trained about the first pulley, passed to and trained about the second pulley, and anchored to the press ram, the movement of the part tray will be faster and greater than the movement of the press ram.

12. A parts unloader as set forth in claim 6 wherein said parts unloader further includes a manually settable brake means to hold the wheeled lower frame in its adjusted position.

13. A parts unloader as set forth in claim 6 wherein said parts unloader is provided with means to lock the upper post part with respect to the press with which it is used.

14. A parts unloader for use with a press having a top delivery die comprising:

a lower frame;

an post mounted on said lower frame and having a generally vertical longitudinal axis;

said post having upper and lower parts telescopically adjustable with respect to each other;

manually controllable power means for controlling telescopic adjustments of the post;

support means mounted on an upper end of the upper part of the post, guide means adjustably mounted on said support means for movement about an axis generally transverse to the longitudinal axis of said post;

means for locking said guide means in any angularly adjusted position with respect to said post;

a slide frame slidably mounted on said guide means for reciprocal movement with respect thereto and at an angle with respect to the post dependent on the angular adjustment of the guide means;

a part tray fixed to said slide frame for movement therewith and having an end extending beyond one end of the slide frame;

pulley means mounted on the guide means for rotation about an axis parallel to the generally transverse axis;

said pulley means includes first and second joined pulleys with the first having an effective diameter greater than the effective diameter of the second, and anchor means on an end of said slide frame opposite from said first mentioned end adapted to anchor a flexible cable;

whereby, said parts unloader is usable with different sizes of presses and when said parts unloader is positioned next to a press with a top delivery die and a flexible cable is anchored to the anchor means, trained about the first pulley, passed to and trained about the second pulley, and anchored to the press ram, the movement of the part tray will be faster and greater than the movement of the press ram, upward movement of the press ram will cause said part tray to move under the press ram and die, and downward movement of the press ram will permit said part tray to move away from under said press ram and die.

* * * * *